US007044136B2

(12) United States Patent
Lee

(10) Patent No.: US 7,044,136 B2
(45) Date of Patent: May 16, 2006

(54) PORTABLE NAIL POLISH REMOVER

(75) Inventor: Kwang-Kuk Lee, Kyunggi-do (KR)

(73) Assignee: You Jin Inc., Kyunggi-do (KR)

( * ) Notice: Subject to any disclaimer, the term of this patent is extended or adjusted under 35 U.S.C. 154(b) by 266 days.

(21) Appl. No.: 10/647,351

(22) Filed: Aug. 26, 2003

(65) Prior Publication Data

US 2005/0072441 A1 Apr. 7, 2005

(30) Foreign Application Priority Data

Aug. 26, 2002 (KR) ..... 20-2002-0025394

(51) Int. Cl.
*A45D 29/18* (2006.01)
*B05C 17/00* (2006.01)

(52) U.S. Cl. ..... 132/74.5; 401/208

(58) Field of Classification Search ..... 132/74.5, 132/73.5; 401/208, 218–200; 15/104.93, 15/104.94

See application file for complete search history.

(56) References Cited

U.S. PATENT DOCUMENTS 1,552,133 A * 9/1925 Frey ..... 132/74.5
4,112,536 A * 9/1978 Carson et al. ..... 15/104.94
4,627,758 A * 12/1986 Winthrop ..... 401/208
4,998,839 A * 3/1991 Bashir ..... 401/208
5,379,477 A * 1/1995 Tamai et al. ..... 15/104.94
6,148,828 A * 11/2000 Bourassa ..... 132/74.5

* cited by examiner

*Primary Examiner*—Kevin Shaver
*Assistant Examiner*—Stephanie L. Willatt
(74) *Attorney, Agent, or Firm*—Greenblum & Bernstein, P.L.C.

(57) ABSTRACT

This invention relates to a portable nail polish remover. The prior nail polish remover has some problems in that, since the remover solution accommodating bottle and the swabs have to be keep individually, the keeping and management for them is troublesome. The remover of the invention comprises a remover body 10 having an opening at an upper end thereof; a non-woven fabric 40 accommodated within the remover body with wound to be exposed through the opening of the remover body; a remover solution receptacle 20 built in the remover body so that a outlet of the remover solution receptacle is directed to the opening of the remover body, the remover solution receptacle providing the non-woven fabric with the remover solution; and a head 30 engaged with the opening of the remover body to open and close the remover body, the head providing the non-woven fabric with the remover solution. Thus, since a user has a nail polish removed with the remover erected, the user may use and treat it simply. Further, the woman may keep and manage simply within her handbag due to its portability.

15 Claims, 3 Drawing Sheets

50
32
33
30
21
20
22
14
11
40
10
13
42
43
41
12

PORTABLE NAIL POLISH REMOVER

TECHNICAL FIELD

This invention relates to a nail polish remover, and more specifically relates to a portable nail polish remover to be used, treated and keep easily.

BACKGROUND ART

Generally, a nail polish is removed by having rag, cotton or tissue paper sucked in a remover solution containing the composition of acetone.

Therefore, according to the prior art, there has been an inconvenience in that a user has to repeat a motion for saturating a cotton-tip of a swab with the remover solution whenever removing the nail polish. That is, while the user removes the nail polish using the cotton-tip of the swab saturated with the remover solution, if the remover solution is evaporated from the cotton-tip of the swab, the user opens again the cap of the remover solution accommodating bottle to saturate the cotton-tip of the swab with the remover solution, and then closes again the cap.

Further, there has been a problem that, since the remover solution accommodating bottle and the swabs have to be keep individually, the keeping and management for them is troublesome.

DISCLOSURE OF INVENTION

In view of the foregoing, it is an object of the invention to provide a nail polish remover adapted to be treated and used simply.

Further, another object of the invention is to provide a nail polish remover adapted to be keep and managed conveniently.

To accomplish the above objects, a nail polish remover according to the invention comprises a remover body having an opening at an upper end thereof, a non-woven fabric accommodated within the remover body with wound to be exposed through the opening of the remover body, a remover solution receptacle built in the remover body so that a outlet of the remover solution receptacle is directed to the opening of the remover body, the remover solution receptacle providing the non-woven fabric with the remover solution, and a head engaged with the opening of the remover body to open and close the remover solution receptacle, the head providing the non-woven fabric with the remover solution.

Preferably, the inside of the remover body is provided with a supplying roller supplying the opening of the remover body with the non-woven fabric and a withdrawing roller withdrawing the non-woven fabric come out of the supplying roller.

Preferably, the remover body is provided with a reverse rotation-preventing projection, and the withdrawing roller is provided with a reverse rotation-preventing lever for hanging on the reverse rotation-preventing projection.

Preferably, a side casing of the remover body is formed with a positioning hole, and the remover solution receptacle is formed with a positioning projection passing through the positioning hole and projecting to the outside.

Preferably, the head engaged with the remover body is integrally formed with a cap for opening and covering the outlet of the remover solution receptacle, and the inclined portion of the head is formed with a plurality of discharging hole for discharging the remover solution supplied from the remover solution receptacle Preferably, the lower end of the remover body is formed with a support for erecting the remover body.

Preferably, the opening of the remover body is provided with a head cap for covering the head.

BRIEF DESCRIPTION OF DRAWINGS

The above and other objects, features and advantages of the invention will be apparent from the following detailed description of the preferred embodiments of the invention in conjunction with the accompanying drawings, in which:

FIGS. 3 and 4 are views for showing the operation of a portable nail polish remover according to the invention, wherein FIG. 3 is a section view for showing the status that a remover solution is not supplied, and FIG. 4 is a section view for showing the status that a remover solution is supplied.

BEST MODE FOR CARRYING OUT THE INVENTION

Figure 1:
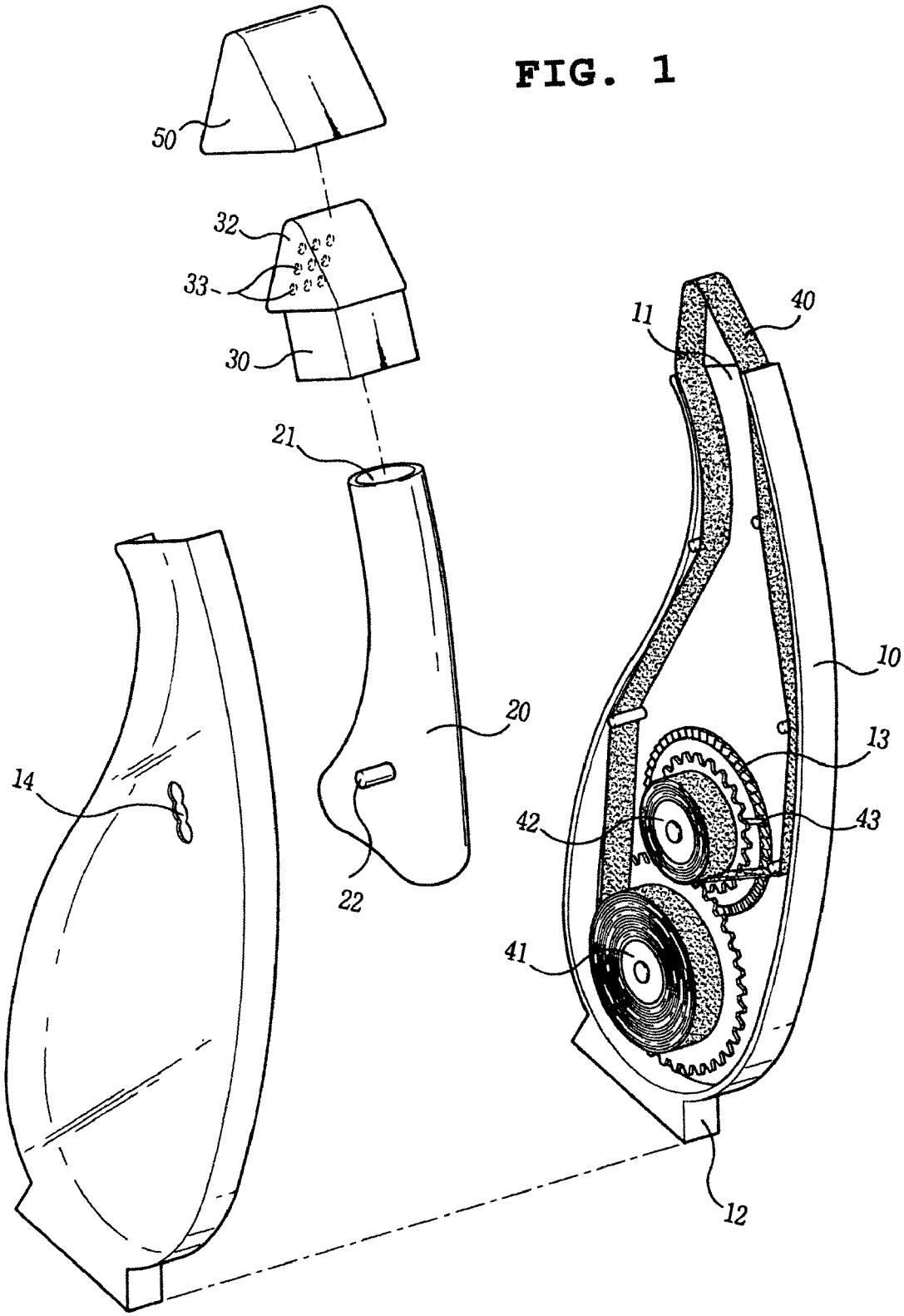
FIG. 1 is a perspective view of a portable nail polish remover according to the invention.
Figure 2:
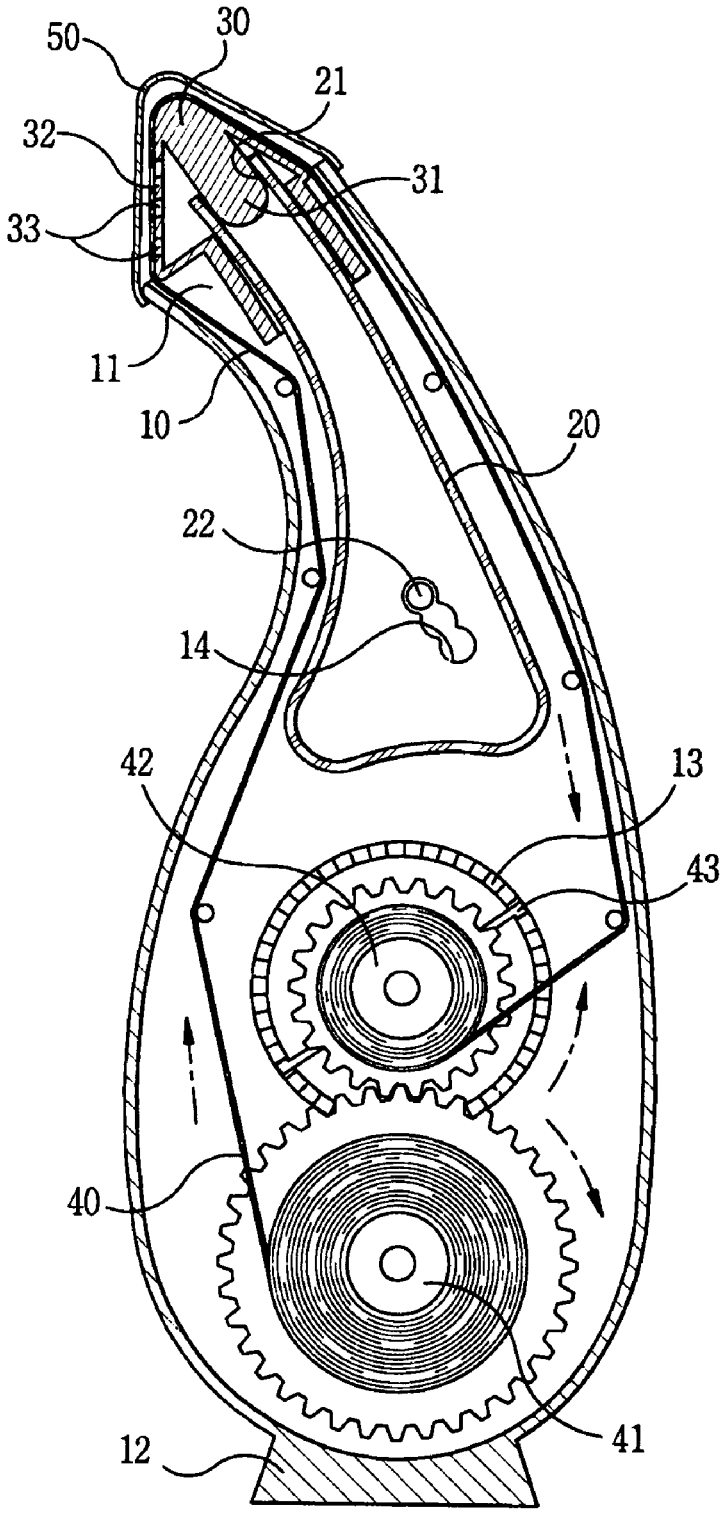
FIG. 2 is a section view of a portable nail polish remover according to the invention.

Referring to FIGS. 1 and 2, the nail polish remover comprises a remover body 10 including an upper casing and a lower casing. The remover body 10 is formed with an opening 11 at its upper end. Further, the remover body 10 is integrally formed with supports 12 disposed with an isosceles square shape at its lower end.

A remover solution receptacle 20 receiving a remover solution is installed within the remover body 10. The remover body 10 is provided with a supplying roller 41 supplying a non-woven fabric 40 and a withdrawing roller 42 withdrawing the non-woven fabric 40 at its lower side. A head 30 is engaged with the opening 11 of the remover body 10, and a head cap 50 covers the upper part of the head 30.

The remover body 10 is formed to being curved in one side direction with having a width narrowing more and more from the lower part to the upper part so that the opening 11 formed at the upper end of the remover body 10 is formed in the inclined status enough to supply the remover solution with the remover body 10 erected.

The remover solution receptacle 20 is erected so that an outlet 21 of the remover solution receptacle 20 corresponds to the opening 11 of the remover body 10.

The head 30 is integrally formed with a cap 31 for opening and covering the outlet 21 of the remover solution receptacle 20, and an inclined portion 32 of the head 30 is formed with a plurality of discharging hole 33 for discharging the remover solution.

The non-woven fabric 40 come out of the supplying roller 41 is passed through the opening 11, and then is winded on a outer surface of the head 30. Then, the non-woven fabric 40 is withdrawn to a withdrawing roller 42 via the opening 11 again.

One casing of the remover body 10 is provided with a reverse rotation-preventing projection 13 for preventing the non-woven fabric 40 come out of the supplying roller 41 from being rotated reversely against the rotating direction winded to the withdrawing roller 42 so that the reverse rotation-preventing projection 13 is formed on the portion corresponding with the withdrawing roller 42. The withdrawing roller 42 is provided with a reverse rotation-preventing lever 43 for hanging on the reverse rotation-preventing projection 13.

Further, the other side casing of the remover body 10 is formed with a positioning hole 14. The remover solution receptacle 20 is formed with a positioning projection 22 passing through the positioning hole 14.

The operation of the above portable nail polish remover according to the invention will be given herein below.

Referring to FIG. 2, if the supplying roller 41 is rotated clockwise, the withdrawing roller 42 engaged with the supplying roller 41 is rotated counterclockwise.

Then, the non-woven fabric 40 winded on the supplying roller 41 is unwound, and then the non-woven fabric 40 contacted on the inclined portion 32 of the head is moved forwardly to be winded on the withdrawing roller 42.

At this time, since the withdrawing roller 42 is rotated only counterclockwise by the reverse rotation-preventing projection 13 constraining the reverse rotation-preventing lever 43, the reverse rotation of the supplying roller 41 and the withdrawing roller 42 is prevented.

Figure 3:
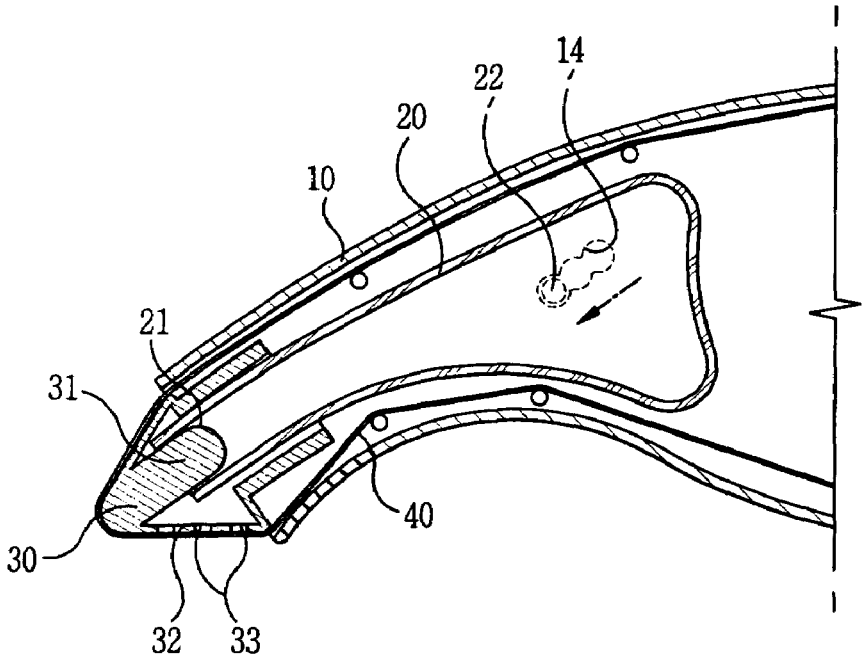

Referring to FIG. 3, the positioning projection 22 of the remover solution receptacle 20 is moved from the positioning hole 14 to the head 30. Further, the cap 31 of the head 30 covers the outlet 21 of the remover solution receptacle 20.

Figure 4:
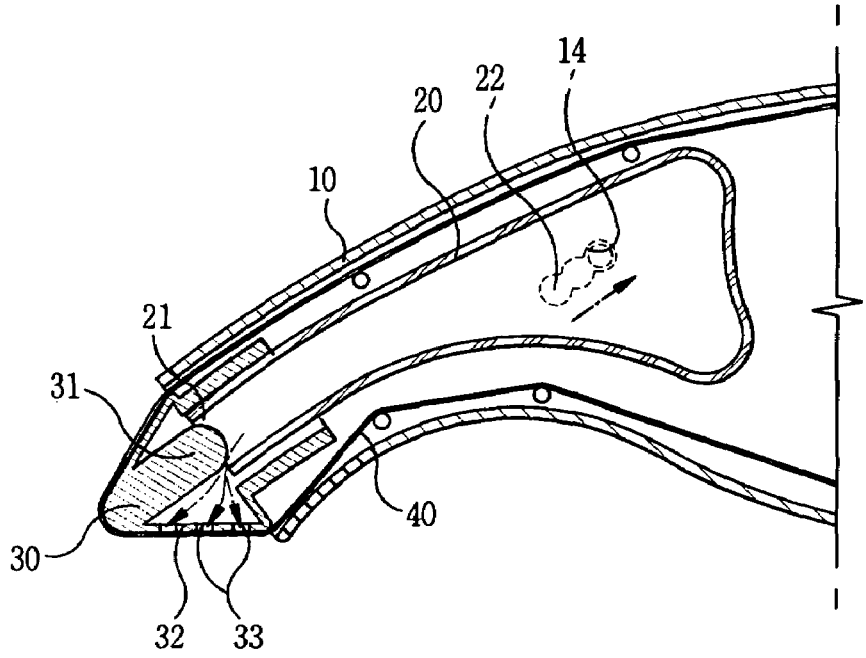

At the status shown in FIG. 4, the positioning projection 22 of the remover solution receptacle 20 is moved to the opponent side of the head 30, the outlet 21 of the remover solution receptacle 20 is open, and then the remover solution flows downwardly out of the remover solution receptacle 20, and then soaks into the non-woven fabric 40 winded on the outer surface of the head 30 via the discharging holes 33 of the head 30.

After a predetermined amount of the remover solution is supplied to the non-woven fabric 40, a user erects the remover body 10, and then removes the nail polish. If the user wants to supply the non-woven fabric 40 with the more remover solution, the user has the remover body 10 tilted slightly so that the remover solution is supplied to the non-woven fabric 40 from the remover solution receptacle 20 via the head 30.

Thus, the remover solution removes the nail polish with continuously supplied to the non-woven fabric 40 exposed to the opening 11 via the discharging hole 33 of the head 30.

After using the portable nail polish remover, the user may keep simply the nail polish remover within a handbag by covering the head 30 with the head cap 50 after closing the outlet 21 of the remover solution receptacle 20 by moving the positioning projection 22 to the opening 11.

From the foregoing, the portable nail polish remover according to the invention simply supplies the non-woven fabric with the remover solution if necessary by having the remover solution receptacle and the non-woven fabric. Further, the non-woven fabric is supplied in the reel type according to the usage state. Therefore, there is an effect in that the nail polish remover is treated and used simply.

Further, there is another effect in that, due to the portability that the remover solution receptacle and the non-woven fabric is built in the remover body, a user may keep and manage conveniently the nail polish remover within a handbag or in a predetermined place.

The present disclosure relates to subject matter contained in priority Korean Patent Application No. 20-2002-25394, filed on Aug. 26, 2002, the contents of which is herein expressly incorporated by reference in its entirety.

What is claimed is:

1. A portable nail polish remover comprising:

a remover body having an opening at an upper end thereof;

a non-woven fabric accommodated within the remover body wound to be exposed through the opening of the remover body;

a remover solution receptacle built in the remover body so that a outlet of the remover solution receptacle is directed to the opening of the remover body, the remover solution receptacle providing the non-woven fabric with the remover solution; and a head engaged with the opening of the remover body to open and close the remover solution receptacle, the head providing the non-woven fabric with the remover solution.

2. The portable nail polish remover according to claim 1, wherein the inside of the remover body is provided with a supplying roller supplying the opening of the remover body with the non-woven fabric and a withdrawing roller withdrawing the non-woven fabric come out of the supplying roller.

3. The portable nail polish remover according to claim 2, wherein the remover body is provided with a reverse rotation-preventing projection, and the withdrawing roller is provided with a reverse rotation-preventing lever for hanging on the reverse rotation-preventing projection.

4. The portable nail polish remover according to claim 1, wherein one side casing of the remover body is formed with a positioning hole, and the remover solution receptacle is formed with a positioning projection passing through the positioning hole and projecting to the outside.

5. The portable nail polish remover according to claim 1, wherein the head engaged with the remover body is integrally formed with a cap for opening and covering the outlet of the remover solution receptacle, and the inclined portion of the head is formed with a plurality of discharging hole for discharging the remover solution supplied from the remover solution receptacle.

6. The portable nail polish remover according to claim 1, wherein the lower end of the remover body is formed with a support for erecting the remover body.

7. The portable nail polish remover according to claim 1, wherein the opening of the remover body is further provided with a head cap for covering the head.

8. The portable nail polish remover according to claim 2, wherein the lower end of the remover body is formed with a support for erecting the remover body.

9. The portable nail polish remover according to claim 3, wherein the lower end of the remover body is formed with a support for erecting the remover body.

10. The portable nail polish remover according to claim 4, wherein the lower end of the remover body is formed with a support for erecting the remover body.

11. The portable nail polish remover according to claim 5, wherein the lower end of the remover body is formed with a support for erecting the remover body.

12. The portable nail polish remover according to claim 2, wherein the opening of the remover body is further provided with a head cap for covering the head.

13. The portable nail polish remover according to claim 3, wherein the opening of the remover body is further provided with a head cap for covering the head.

14. The portable nail polish remover according to claim 4, wherein the opening of the remover body is further provided with a head cap for covering the head.

15. The portable nail polish remover according to claim 5, wherein the opening of the remover body is further provided with a head cap for covering the head.

* * * * *